United States Patent [19]

Kelly et al.

[11] 4,281,688

[45] Aug. 4, 1981

[54] REVERSIBLE FORMING FABRIC HAVING DOMINATING FLOATS ON EACH FACE

[75] Inventors: Brendan W. Kelly, Beaconsfield; Robert L. Boily, Joliette, both of Canada

[73] Assignee: Scapa Dryers (Canada) Ltd., Joliette, Canada

[21] Appl. No.: 35,064

[22] Filed: May 1, 1979

[51] Int. Cl.[3] ..... D03D 25/00

[52] U.S. Cl. ..... 139/383 A; 139/425 A; 162/DIG. 1

[58] Field of Search ..... 139/383 R, 383 A, 425 R, 139/425 A; 162/DIG. 1, 348

[56] References Cited

U.S. PATENT DOCUMENTS

| | | | |
|---|---|---|---|
| 3,214,331 | 10/1965 | Wicker | 139/383 A |
| 3,464,459 | 9/1969 | Ballard | 139/383 R |
| 3,502,116 | 3/1970 | Crawford | 139/425 A |
| 4,161,195 | 7/1979 | Khan | 139/425 A |
| 4,206,787 | 6/1980 | Strandly | 139/383 A |

OTHER PUBLICATIONS

Grammar of Textile Design, by Nispet, Pub. Feb. 1927, p. 87, Fig. 228.

*Primary Examiner*—Henry Jaudon

*Attorney, Agent, or Firm*—Fleit & Jacobson

[57] ABSTRACT

A two-face, single-layer forming fabric, having a plurality of dominating floats on each face. The fabric, in general, comprises a plurality of cross-machine direction yarns and a plurality of machine direction yarns interwoven in accordance with a desired weave pattern to define a first substantially planar surface or face on one side of the fabric, and a second substantially planar surface or face on the other side of the fabric.

In one embodiment of the fabric, all alternate cross-machine direction yarns form alternating first floats and first knuckles, the first floats being on the first surface and the first knuckles being on the second surface. All of the remaining cross-machine direction yarns form alternating second floats and second knuckles, the second floats being on the second surface and the second knuckles being on the first surface.

In another embodiment, the first and second groups of knuckles are replaced by floats, which are of equal size in that they span the same number of machine direction yarns. Further, in this embodiment, the first and second floats are of equal size, whereas, the newly introduced floats are of a different size than the first and second floats.

13 Claims, 11 Drawing Figures

REVERSIBLE FORMING FABRIC HAVING DOMINATING FLOATS ON EACH FACE

BACKGROUND OF THE INVENTION

1. Field of the Invention

The subject invention relates to fabrics, in general, and to a reversible single layer forming fabric having a preponderance of dominating cross-machine direction floats on each face, in particular.

2. Description of the Prior Art

In papermaking machines, paper stock, also called furnish or stuff, is fed onto the top surface or outer face of traveling endless papermaking belts, which serve as the papermaking surface of the machine. The bottom surface, or innerface, of the endless belts is supported on and driven by rolls associated with the machine. Papermaking belts, also known as Fourdrinier wires, forming media or forming fabrics, are commonly configured from a length of woven fabric with its ends joined together in a seam to provide an endless belt. The fabric may also be constructed by employing an endless weave process, thereby eliminating the seam. Either fabric generally comprises a plurality of machine direction yarns and a plurality of cross-machine direction yarns which have been woven together on a suitable loom.

Initially, forming fabrics were woven wire structures made from materials such as phosphor bronze, bronze, stainless steel, brass, or suitable combinations thereof. Recently, in the papermaking field, it has been found that synthetic materials may be used, in whole or in part, to produce forming fabrics of superior quality. Today, almost all forming fabrics are made from polyesters such as Dacron or Trevira, acrylic fibers such as Orlon, Dynel and Acrilan, copolymers such as Saran, or polyamides such as Nylon. The warp and weft yarns of the forming fabric may be of the same or different constituent material and/or constructions, and may be in the form of a monofilament or multifilament yarn.

In the prior art, various single layer forming fabrics have been made by employing weave patterns ranging from the $1\times1$ plain weave, progressing in stages to the $4\times1$ straight and broken twill or satin weaves. Each of these fabrics suffer from the same shortcoming: the rapid wear of the knuckles contained on the innerface of the fabric when the knuckles are brought into contact with the rolls during the papermaking process. As used herein, a knuckle is a portion of a weft yarn that passes over (or under) only one warp yarn, or a portion of a warp yarn that passes over (or under) only one weft yarn before interweaving.

Many of the prior art forming fabrics employ cross-machine direction floats on either the outer or the inner surface. As used herein, a float is a portion of a weft yarn that passes over (or under) two or more warp yarns, or a portion of a warp yarn that passes over (or under) two or more weft yarns before interweaving. For example, a weft yarn that passes over three warp yarns before interweaving will, herein, be referred to as a three-float. These cross-machine direction floats, in conjunction with the knuckles present on the inner surface of the fabric, have a tendency to curl the edges of the fabric in a direction towards the outer surface on which the cross-machine direction floats are located. It is believed that such edge curling results from tension differentials on the top and bottom surfaces of the fabric, caused by differences in the area occupied by knuckles and floats on one surface of the fabric and knuckles and floats on the other surface.

Further, the relationship between knuckle and float placement on prior art fabrics leads to a trade-off between the smoothness of the finished paper and the life of the fabric due to machine wear. For example, if the floats are on the paper-receiving surface, a smoother paper surface will result with an attendant decrease in fabric life due to knuckle wear. Alternatively, if the floats are on the machine-contacting surface, fabric life will be increased due to the greater wearing surface provided by the floats, but the smoothness of the paper will be greatly diminished because of the preponderance of knuckles occupying the paper-receiving surface.

If the preponderance of cross-machine direction floats are on the outer or paper-receiving surface of the fabric, the edges have a tendency to curl upwardly and, hence, cause the paper stock to "roll" down the curled edge to thereby produce a raised portion on the finished paper. If the cross-machine direction floats are on the inner or roll-contacting surface of the fabric, the edges tend to curl downwardly, and there is a tendency for the fabric edges to wear down as they contact the rolls, suction boxes, and various other support equipment of the papermaking machine. Such curling tendency also results in grooves being worn into the rolls, suction boxes, etc. Thus, with upward edge curl, the full width of the forming fabric cannot be used to make paper, and with downward edge curl, the papermaking machine is, itself, subjected to excessive wear.

In the prior art, for the most part, there is also a trade-off between factors, such as, strength and stability on the one hand and permeability on the other. For example, if strength and stability were to be maximized, as by using more yarns per inch in the finished fabric, then the permeability of the fabric would fall correspondingly. Therefore, because forming fabrics require high permeabilities to ensure adequate drainage, strength and stability are often sacrificed in favor of drainage considerations.

It is, therefore, desirable to produce a forming fabric in which edge curl and knuckle wear are kept to a minimum without sacrificing the quality of the finished paper. It is also desirable to produce a forming fabric having strength and stability, and yet also having high permeability. The present invention is directed toward producing such a fabric.

SUMMARY OF THE INVENTION

The subject invention relates to a two-face, single-layer forming fabric, having a plurality of dominating floats on each face. The fabric, in general, comprises a plurality of cross-machine direction yarns and a plurality of machine direction yarns interwoven in accordance with a desired weave pattern to define a first substantially planar surface or face on one side of the fabric, and a second substantially planar surface or face on the other side of the fabric.

In one embodiment of the fabric, all alternate cross-machine direction yarns form alternating first floats and first knuckles, the first floats being on the first surface and the first knuckles being on the second surface. All of the remaining cross-machine direction yarns form alternating second floats and second knuckles, the second floats being on the second surface and the second knuckles being on the first surface.

In another embodiment, the first and second groups of knuckles are replaced by floats, which are of equal size in that they span the same number of machine direction yarns. Further, in this embodiment, the first and second floats are of equal size, whereas, the newly introduced floats are of a different size than the first and second floats.

A fabric embodying the teachings of the subject invention can truly be characterized as a reversible fabric in that each face of the fabric has a similar structure. Further, through the arrangement of floats, wherein they occupy substantially equal areas of each face, the problem associated with edge curling is minimized.

A fabric, embodying the subject invention, can be woven with more threads per unit area, thereby further strengthening the fabric and presenting a greater surface to balance the support area required for sheet smoothness on the outer surface with an increase in the wearing surface or the inner face to provide longer useful fabric life.

It is, therefore, an object of the present invention to provide a forming fabric in which edge curl and knuckle wear are kept to a minimum without sacrificing the quality of the finished paper.

It is another object of the present invention to provide a reversible forming fabric, both sides of which may be used to produce a paper of similar characteristics.

It is a further object of the present invention to provide a forming fabric with increased surface area to extend the useful life of the fabric without sacrificing sheet smoothness.

It is still another object of the present invention to provide a forming fabric with increased wire life characteristics.

It is yet another object of the present invention to provide a forming fabric which exhibits improved fine retention, because the size of the interstices between the yarns are reduced due to the increased number of yarns for a given fabric permeability.

Additional objects of the present invention will become apparent from a reading of the appended specification and claims in which, preferred, but not necessarily the only, forms of the invention will be described in detail, taken in connection with the drawings accompanying and forming a part of the application.

DETAILED DESCRIPTION OF THE PREFERRED EMBODIMENTS

Figure 1:
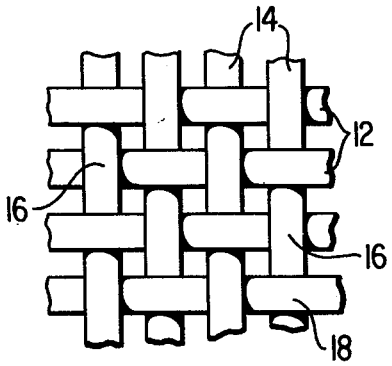
FIG. 1 PRIOR ART
FIG. 1 is a plan view of a prior art fabric embodying a 1×1 plain weave.

In describing the preferred embodiments of the present invention as illustrated in the drawings, specific terminology will be resorted to, for the sake of clarity. However, the invention is not intended to be limited to the specific terms so selected, and it is to be understood that each specific term includes all technical equivalents which operate in a similar manner to accomplish a similar purpose.

Figure 2:
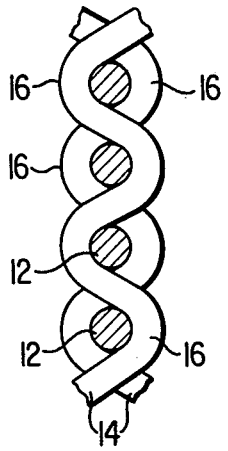
FIG. 2 PRIOR ART
FIG. 2 is a longitudinal section of the prior art fabric of FIG. 1.

FIGS. 1 through 6 are examples of prior art weave patterns used to produce forming fabrics. FIGS. 1 and 2 illustrate an example of a plain weave comprising a plurality of cross-machine direction yarns 12 interwoven with a plurality of machine direction yarns 14. Each machine direction yarn 14 spans one cross-machine direction yarn 12 to form knuckles 16 on both faces of the fabric. In the same way, each cross-machine direction yarn 12 spans one machine direction yarn 14 to form knuckles 18 on both faces of the fabric.

Figure 3:
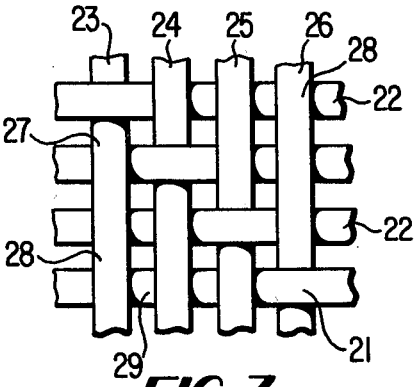
FIG. 3 PRIOR ART
FIG. 3 is a plan view of a prior art fabric embodying a 3×1 twill weave.
Figure 4:
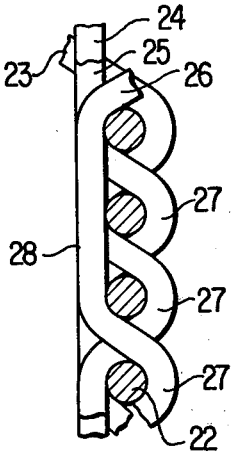
FIG. 4 PRIOR ART
FIG. 4 is a longitudinal section of the prior art fabric of FIG. 3.

FIGS. 3 and 4 illustrate a 3×1 twill weave pattern comprising a plurality of cross-machine direction yarns 22 and a plurality of machine direction yarns 23–26. Each machine direction yarn spans one cross-machine direction yarn to form a knuckle 27 on one side of the fabric, and spans three cross-machine direction yarns to form a three-float 28 on the other side of the fabric. In the same way, each cross-machine direction yarn 22 spans one machine direction yarn, for example yarn 26, to form a knuckle 21 on one side of the fabric, and spans three machine direction yarns, for example yarns 23–25, to form a three-float 29 on the other side of the fabric.

Figure 5:
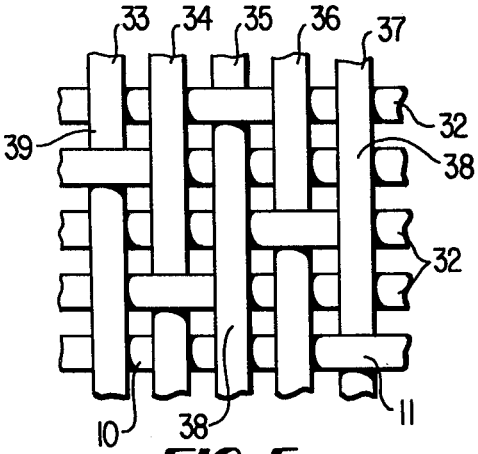
FIG. 5 PRIOR ART
FIG. 5 is a plan view of a prior art fabric embodying a satin weave.
Figure 6:
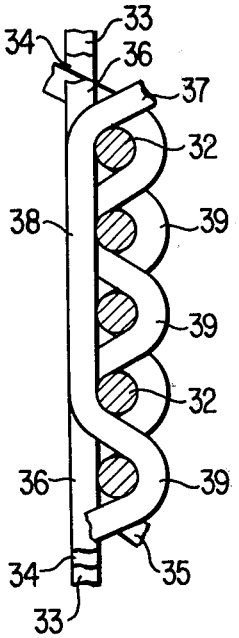
FIG. 6 PRIOR ART
FIG. 6 is a longitudinal section of the prior art fabric of FIG. 5.

FIGS. 5 and 6 illustrate a five-harness satin weave pattern comprising a plurality of cross-machine direction yarns 32 and a plurality of machine direction yarns 33–37. Each machine direction yarn spans one cross-machine direction yarn to form a knuckle 39 on one side of the fabric, and spands four cross-machine direction yarns to form a four-float 38 on the other side of the fabric. In like manner, each cross-machine direction yarn 32 spans one machine direction yarn, for example yarn 37, to form a knuckle 11 on one side of the fabric, and spands four machine direction yarns, for example yarns 33–36, to form a four-float 10 on the other side of the fabric.

Each of the prior art forming fabrics illustrated in FIGS. 1 through 6, when in use, has the knuckles of the machine direction yarns pressing against the rolls and other elements of a papermaking machine. With this arrangement, the machine direction yarns wear rapidly at the knuckle sites, thus, decreasing the useful life of the fabric. Further, while the machine direction yarn floats present in the prior art embodiments of FIGS. 3 through 6 enhance the smoothness of a finished paper product, the cross-machine direction floats produce edge curling with the resultant detrimental effects, as described hereinbefore.

The present invention substantially reduces the problem of knuckle wear in that there are less knuckles per unit area on each surface and, also, minimizes the curling of the edges in fabrics embodying the subject invention. At the same time, the present invention offers an improved balance between fabric cost, stability, permeability, and paper characteristics.

Figure 7:
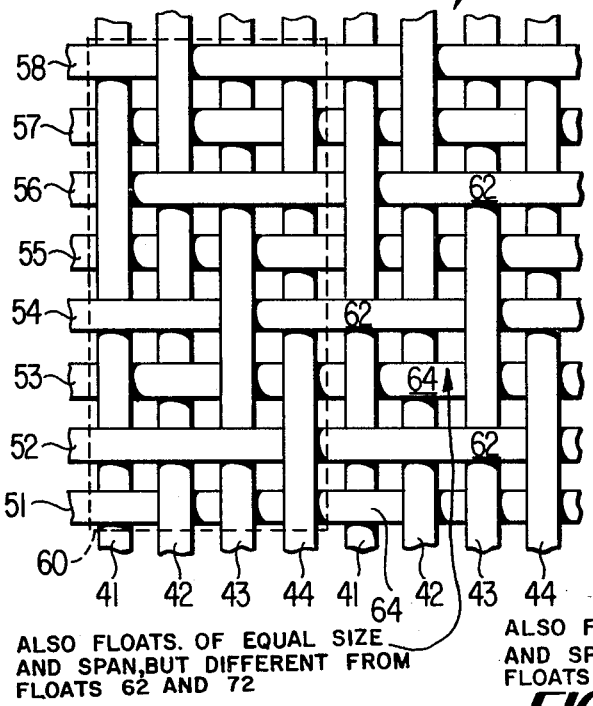
FIG. 7 is a top plan view of a fabric embodying the subject invention.
Figure 9:
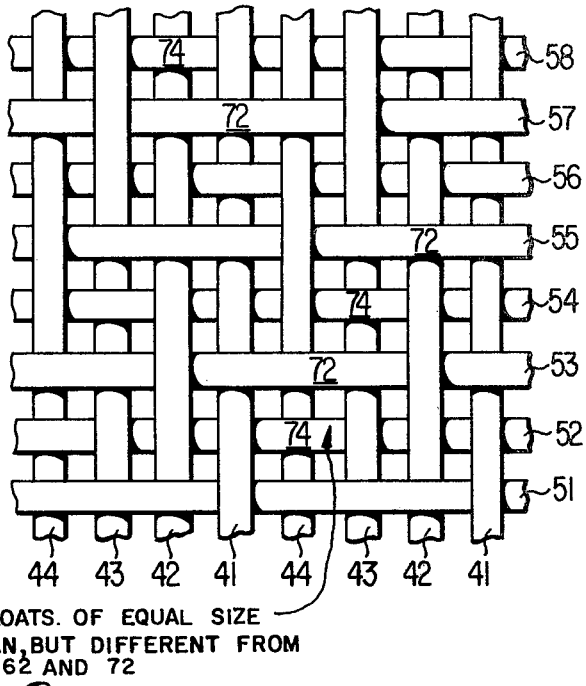
FIG. 9 is a bottom plan view of the fabric of FIG. 7.
Figure 8:
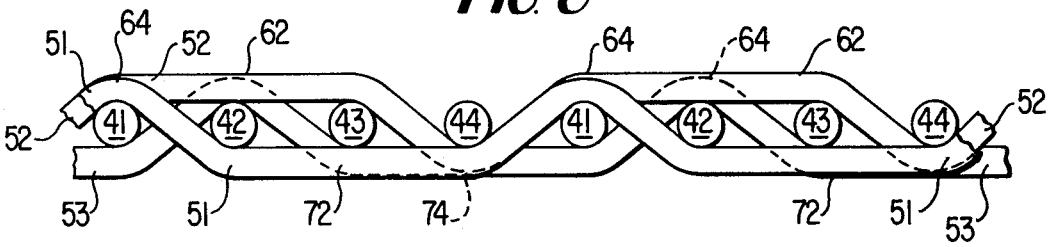
FIG. 8 is a transverse schematic section of the fabric of FIG. 7.

With reference to FIGS. 7 through 9, a preferred embodiment of the invention will now be described. A forming fabric embodying the subject invention is generally designated as 40, and comprises a plurality of machine direction yarns 41–44, interwoven with a plurality of cross-machine direction yarns 51–58.

Figure 10:
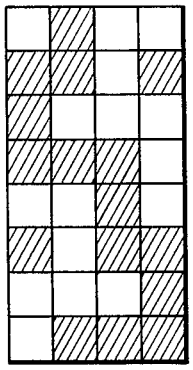
FIG. 10 is a weave pattern for the fabric of FIG. 7.

With reference to FIG. 10, the technical design of a weave is called a weave pattern. A weave pattern can be drawn on a squared paper, on which the vertical lines of squares generally represent warp yarns, while the horizontal lines represent weft yarns. A filled-in square indicates that the warp yarn it represents is above the weft, whereas, a blank means weft above warp. Every pattern repeats itself. The area comprising the minimum number of warp and weft intersections constituting the pattern is called a "round of weave". For the illustrated embodiment, the round of weave is designated by the number 60.

In weaving a fabric, warp yarns are raised and lowered in a predetermined sequence, determined by the weave pattern, so that they form a "shed" or passage for weft yarns. The formation of the passage is referred to in the art as "shedding". Inserting a weft yarn between the divided warp yarns is called "picking".

A weave pattern is read from left to right and from bottom to top. Thus, the weave pattern of FIG. 10 contains the following sequence of shedding and picking instructions:

shedding instruction No. 1—raise all warp yarns except the first which is lowered picking instruction No. 1—pick first weft yarn shedding instruction No. 2—lower all warp yarns except the fourth which is raised picking instruction No. 2—pick second weft yarn shedding instruction No. 3—raise all warp yarns except the second which is lowered picking instruction No. 3—pick third weft yarn shedding instruction No. 4—lower all warp yarns except the third which is raised picking instruction No. 4—pick fourth weft yarn shedding instruction No. 5—raise all warp yarns except the fourth which is lowered picking instruction No. 5—pick fifth weft yarn shedding instruction No. 6—lower all warp yarns except the first which is raised picking instruction No. 6—pick sixth weft yarn shedding instruction No. 7—raise all warp yarns except the third which is lowered picking instruction No. 7—pick seventh weft yarn shedding instruction No. 8—lower all warp yarns except the second which is raised picking instruction No. 8—pick eighth weft yarn It is to be understood, that this sequence of shedding and picking instructions will yield several rounds of weave across the breadth of the loom. When a fabric is woven (assuming that the fabric is woven flat and subsequently seamed), the weft-direction rounds of weave are repeated a sufficient number of times to yield a forming fabric of desired length. The width of the fabric is determined by the number of yarns in place across the breadth of the loom. It should be noted at this point, that the weave pattern illustrated in FIG. 10 is presented as an example of a four-harness broken twill weave pattern, used to generate an embodiment of the subject invention. It is not intended to limit the scope of the subject invention, since there are numerous forming fabric weave patterns which may be used within the teachings of the subject invention.

FIG. 7 best illustrated one surface or face of the forming fabric 40, for example, the face which receives the paper stock during the papermaking process. It has been noticed that by being woven in the manner just described, the fabric contains many attributes which enhance paper production. Among these are the plurality of cross-machine direction three-floats 62, which enhance the smoothness of the finished paper product, by exposing a greater surface to support the sheet and thereby reducing the tendency of the sheet to be marked by the fabric. Further, it has been observed that a fabric embodying the teachings of the subject invention exhibits permeability characteristics similar to prior art fabrics that contain fewer yarns per inch than the present fabric. Finally, forming fabric 40 gives better fine retention by containing more interstices than prior art fabrics of the same permeability.

Tests have been conducted to compare the permeability characteristics of the forming fabric 40 with certain prior art fabrics. A prior art four-harness broken twill, woven to have a yarn density of 76 ends per inch and 54 picks per inch, was found to have a permeability characteristic of 640 cfm. The forming fabric 40, when similarly tested, was found to have the same cfm as the prior art fabric but with a greater yarn density, i.e., 76 ends per inch and 69 picks per inch. In each case, the diameter of the machine direction yarns was 0.20 mm, and the diameter of the cross-machine directions yarns was 0.22 mm.

FIG. 9 shows the reverse side of the fabric 40 of FIG. 7, and reveals the surface or face that would, in the example given, contact the rolls and other machine elements during the papermaking process. Like numerals designate like elements, and only the additional features will be described. As can be seen, the underside of the fabric contains a plurality of cross-machine direction three-floats 72 as well as a plurality of cross-machine direction knuckles 74.

It has been observed, that in a forming fabric 40 wherein alternate cross-machine direction yarns 51, 53, 55 and 57 define knuckles 64 on the paper-receiving surface and three-floats 72 on the machine-contacting surface and, wherein the remaining alternate cross-machine direction yarns 52, 54, 56 and 58 define knuckles 74 on the machine-contacting surface and three-floats 62 on the paper-receiving surface, a phenomenon takes place, which greatly improves paper quality and fabric life. This phenomenon will be explained with reference to FIG. 8, which shows, in schematic form, a transverse section of the forming fabric 40 with the first three cross-machine direction yarns 51–53. As can be seen, the three-floats 62 and 72 tend to dominate the knuckles 64 and 74 on their corresponding surfaces. Thus, the floats 62 and 72 tend to shelter the knuckles 64 and 74, respectively. In the case of the paper-receiving surface, floats 62 provide a substantial float area for support of the paper. In like manner, floats 72 on the machine-contacting surface provide a substantial float area for supporting the fabric as it contacts the various machine elements during the papermaking process.

As stated hereinbefore, the edge of a forming fabric has a tendency to curl toward a surface containing a preponderance of cross-machine direction floats. It has been observed that by producing a fabric whose alternate cross-machine direction yarns contain floats of similar size, span, and distribution between the two faces of the fabric, edge curling is minimized.

As discussed, hereinbefore, with reference to FIG. 10, the fabric 40 may be produced by the flat weave process in which the machine direction yarns comprise a plurality of warp yarns and the cross-machine direction yarns comprise a plurality of weft yarns. It is to be understood, however, that the fabric may be produced by the endless weave process, in which the machine direction yarns comprise continuous weft yarns and the cross-machine direction yarns comprise a plurality of warp yarns.

Figure 11:
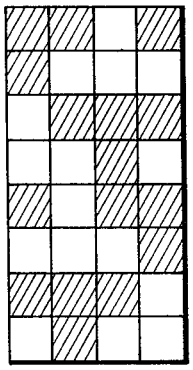
FIG. 11 is a weave pattern for another embodiment of the subject invention.

It is also possible to use other weave patterns in order to generate a fabric embodying the subject invention. One such weave pattern is shown in FIG. 11, wherein the shedding and picking instructions may be read in the same manner as previously described with reference to FIG. 10. Further, it is contemplated that the knuckles 64 and 74 may be replaced by floats of equal size and span, the only requirement being that the new floats be of a different size that the floats 62 and 72 which are of equal size and span.

Because the dominating floats 62 and 72 are arranged in equal numbers on both sides of the fabric, the fabric may be reversed in accordance with user preference to produce a paper of the same quality without any sacrifice in fabric life.

It is to be understood that the embodiments previously described are by way of illustration only and that any fabric may benefit from the teachings of the subject invention. In particular, any fabric which contains alternating cross-machine direction yarns, each, in turn, producing alternating floats of equal size and span on opposite surfaces of the fabric, will produce a fabric in which the problem associated with knuckle wear is substantially reduced or eliminated, and the problem associated with edge curling is minimized. Further, the fabric will exhibit a greater life characteristic because the float arrangement provides a large support area for the fabric when contacting the machine parts.

Obviously, many modifications and variations of the present invention are possible in light of the above teachings, and it is contemplated that, within the scope of the appended claims, the invention may be practiced otherwise, than as specifically described.

What is claimed is:

1. A forming fabric having a paper stock receiving surface and a roll-contacting surface, said forming fabric comprising a plurality of interwoven machine direction yarns and a plurality of cross-machine direction yarns, every other of said cross-machine direction yarns spanning a first number of adjacent machine direction yarns in defining one of said surfaces and spanning a second number of machine direction yarns in defining the other of said surfaces, said second number being different from said first number, said machine direction yarns of said second number being adjacent when said second number is greater than one; and the remainder of said cross-machine direction yarns spanning a third number of adjacent machine direction yarns in defining said other surface and spanning a fourth number of machine direction yarns in defining said one surface, said machine direction yarns of said fourth number being adjacent when said fourth number is greater than one, and said third and fourth numbers being equal to said first and second numbers, respectively.

2. The forming fabric of claim 1, wherein said first and third numbers are three and said second and fourth numbers are one.

3. The forming fabric of claim 1, wherein said one surface is said paper stock receiving surface.

4. The forming fabric of claim 1, wherein said one surface is said roll-contacting surface.

5. The forming fabric of claim 1, wherein said fabric is a single layer fabric.

6. The forming fabric of claim 1, wherein said plurality of machine direction yarns and said plurality of cross-machine dirction yarns are interwoven in accordance with a repeatable weave pattern containing four ends and eight picks.

7. The forming fabric of claim 1, wherein said yarns are synthetic yarns.

8. The forming fabric of claim 1, wherein at least one of said yarns is a monofilament.

9. The forming fabric of claim 1, wherein at least one of said yarns is a multifilament.

10. A single layer forming fabric having a paper stock receiving surface and a roll-contacting surface, said forming fabric comprising a plurality of interwoven machine direction yarns and cross-machine direction yarns, all alternate cross-machine direction yarns of said plurality forming alternating first floats and first knuckles, said first floats being on and contributing to define one of said surfaces, said first knuckles being on and contributing to define the other of said surfaces, and all remaining cross-machine direction yarns of said plurality forming alternating second floats and second knuckles, said second floats being on and contributing to define said other surface and said second knuckles being on and contributing to define said one surface, wherein said paper stock receiving and said roll-contacting surfaces have substantially the same structure.

11. A forming fabric having a paper stock receiving surface and a roll-contacting surface, said forming fabric comprising a plurality of interwoven machine direction yarns and cross-machine direction yarns, all alternate cross-machine direction yarns of said plurality forming alternating first and second floats of unequal size, said first floats being on and contributing to define one of said surfaces and said second floats being on and contributing to define the other of said surfaces, and all remaining cross-machine direction yarns of said plurality forming alternating third and fourth floats of unequal size, said third floats being on and contributing to define said other surface and said fourth floats being on and contributing to define said one surface, the size of said first and third floats being equal and the size of said second and fourth floats being equal, wherein said paper stock receiving and said roll-contacting surfaces have substantially the same structure.

12. A reversible forming fabric having a first face and a second face opposite said first face, said forming fabric comprising a plurality of interwoven machine direction yarns and cross-machine direction yarns, a substantially equal number of first cross-machine direction floats of equal size on each of said faces, and a substantially equal number of second cross-machine direction floats of equal size on each of said faces, said first floats being of different size than said second floats, wherein said first and second faces have substantially the same structure.

13. A forming fabric having a paper stock receiving surface and a roll-contacting surface, said forming fabric comprising a plurality of machine direction yarns and cross-machine direction yarns interwoven in accordance with a preselected weave pattern, every other of said cross-machine direction yarns each repeatedly first spanning a first number of adjacent machine direction yarns in defining one of said surfaces and then spanning a second number of machine direction yarns in defining the other of said surfaces, said second number being different from said first number, said machine direction yarns of said second number being adjacent when said second number is greater than one; and the remainder of said cross-machine direction yarns each repeatedly first spanning a third number of adjacent machine direction yarns in defining said other surface and then spanning a fourth number of machine direction yarns in defining said one surface, said machine direction yarns of said fourth number being adjacent when said fourth number is greater than one, said third number being different from said fourth number, wherein said weave pattern is chosen so that said paper stock receiving and roll-contacting surfaces have substantially the same structure.

* * * * *